United States Patent [19]

Yu

[11] Patent Number: 4,474,225

[45] Date of Patent: Oct. 2, 1984

[54] METHOD OF DIRECT CHILL CASTING

[75] Inventor: Ho Yu, Murrysville, Pa.

[73] Assignee: Aluminum Company of America, Pittsburgh, Pa.

[21] Appl. No.: 381,237

[22] Filed: May 24, 1982

[51] Int. Cl.[3] ..... B22D 11/124

[52] U.S. Cl. ..... 164/467; 164/487

[58] Field of Search ..... 164/467, 486, 487, 475, 164/415, 444, 503, 66.1, 268

[56] References Cited

U.S. PATENT DOCUMENTS

| | | | |
|---|---|---|---|
| 3,463,220 | 8/1969 | Moritz | 164/487 X |
| 3,467,166 | 9/1969 | Getselev et al. | 164/487 X |
| 3,713,479 | 1/1973 | Bryson | 164/487 |
| 3,726,336 | 4/1973 | Moritz | 164/444 X |
| 3,771,584 | 11/1973 | Wojcik | 164/486 X |
| 4,166,495 | 9/1979 | Yu | 164/486 |

*Primary Examiner*—Nicholas P. Godici
*Assistant Examiner*—J. Reed Batten, Jr.
*Attorney, Agent, or Firm*—Carl R. Lippert

[57] ABSTRACT

Molten aluminum, magnesium, or their alloys, or other metal is solidified in a mold or casting device from which an ingot is continuously and progressively withdrawn. The ingot as initially formed has a solid shell and a liquid core which progressively solidifies as the ingot is withdrawn through and from the casting device. As the ingot emerges from the casting device it is contacted directly with water or other coolant referred to as direct chill. Improved casting rates can be achieved without cracking the ingot where the direct chill cooling effects are divided into three successive zones. In the first direct chill zone a relatively high chill rate is employed, after which a retarded chill rate is employed in a second direct chill zone followed by a higher chill rate in a third direct chill zone. Thus, the ingot is drawn through a high direct chill rate zone then a lower direct chill rate zone and then a higher direct chill rate zone. The intermediate low chill rate zone is effected preferably by use of a dissolved gas such as carbon dioxide, which establishes a heat insulating film or layer around the solidifying ingot to retard heat extraction. At a predetermined distance from the mold that film is then mechanically disturbed as by a comb, rake or other mechanical action or as by a jet of water, air or other fluid to establish a higher chill rate for the third zone.

47 Claims, 4 Drawing Figures

METHOD OF DIRECT CHILL CASTING

BACKGROUND OF THE INVENTION

In the continuous or semi-continuous casting of molten aluminum or other metal ingots there is a desire to increase the rate at which ingots are cast or withdrawn from the mold or casting device both to improve production rate and to improve the surface condition of the ingot so produced. Many attempts have been made to accomplish such, but have often been marked by a propensity to form cracks in the ingot wherein a higher casting rate produces better production rates but higher rejection rates because of ingot cracks. Another problem is that some retarded chill rate systems used to reduce cracks result in internal porosity which reduces the usefulness of the solidified metal.

U.S. Pat. No. 3,713,479, incorporated herein by reference, addresses this type of problem to some extent and relies upon different cooling zones. Similarly, U.S. Pat. Nos. 3,463,220 and 3,726,336, incorporated herein by reference, are concerned with the reduction of ingot cracks in producing ingots at relatively high production rates employing air and water-cooling mixtures. The various methods employed to date each are considered to have shortcomings either insofar as the results achieved or difficulty in control or in implementation of the system.

SUMMARY OF THE INVENTION

In accordance with the invention, the solidifying ingot, typically as it exits the mold or casting device, is direct chilled in three successive zones. The first and third zones cool at relatively high rates, whereas the intermediate second zone cools at a reduced rate. Thus the initially solidifying ingot is directly contacted with coolant to extract heat at a relatively high rate in a first zone, then at a lower rate in a second zone and then at a high rate in a third zone. The same coolant initially applied in the first zone can cool all three zones. The reduced cooling in the second zone is effected by retarding the heat extraction rate of the coolant employed in the first zone as by the use of a dissolved gas or other means to promote a stable insulating film on the solidifying ingot surface. The retarded cooling zone is terminated by disrupting that film as by mechanically disturbing it which can be effected by a jet of water or air or even by a rake or comb action.

THE DRAWINGS

In the following description reference is made to the drawings in which.

GENERAL DESCRIPTION

Figure 1:
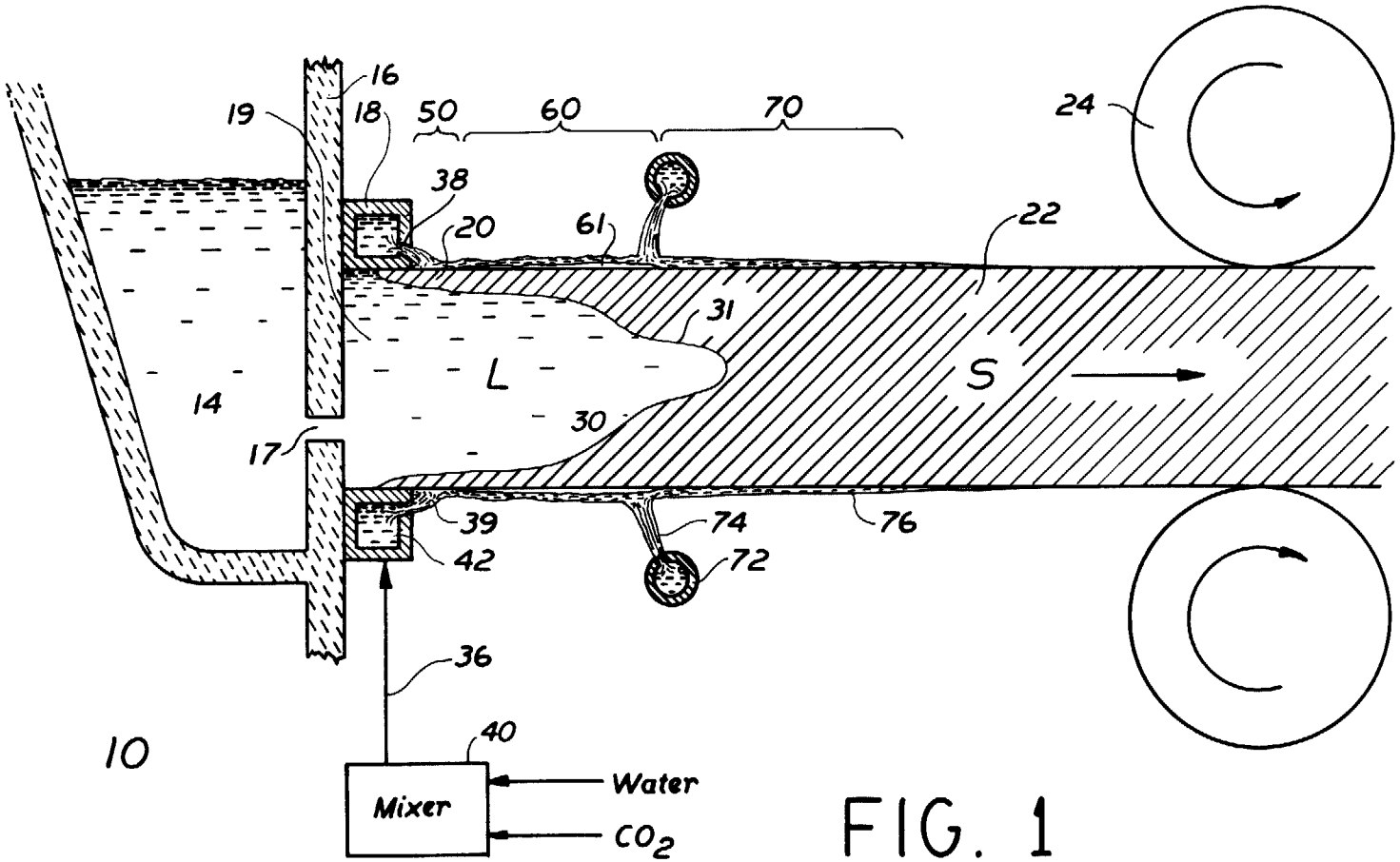
FIG. 1 is an elevation view partly in cross-section schematically illustrating the practice of the invention for horizontal casting.

Referring to FIG. 1, the improved system 10 is illustrated including a reservoir 14 containing molten metal separated from mold 18 by a refractory or other barrier

16 having an orifice 17 therethrough to conduct molten metal from the reservoir 14 into the area or cavity 19 of the mold 18. The molten metal is contacted in heat exchange relationship with the chilled internal surfaces of the mold 18 and partially solidified to form a shell 20 containing a liquid core 30 for solidified ingot 22 which is continuously withdrawn by the action of rollers 24. In FIG. 1 "L" refers to liquid or molten metal and "S" refers to solidified metal. Coolant is supplied to the mold or casting device 18 by supply line 36 such that the coolant, such as water, can cool the mold or casting device 18 to compensate for heat removed from the solidifying metal by mold 18. The coolant then exits the mold 18 through passages 38 and impinges as streams 39 upon the surface of the solidifying shell 20 and partially solidified ingot to directly chill said surface and extract heat by coolant contact therewith. The mold 18 is shown in FIG. 1 as a contact mold, internally-cooled as by water-cooling, but the term "mold" or "casting device" as employed herein is intended to include electromagnetic molds such as depicted in U.S. Pat. No. 3,467,166, incorporated herein by reference. In the case of electromagnetic molds there typically may be no contact against the mold and substantially all the heat of solidification is typically removed by direct chill contact with fluid cooling media.

In accordance with the invention, the coolant, such as water, is combined with an added agent which promotes film boiling rather than nucleate boiling, or at least promotes a disruptable but stable and sustained insulating gas or vapor layer on the ingot surface. It is desired that such agent be provided in an amount effective to provide for such stable and sustained layer. One such substance which is preferred from the standpoint of economics and control is a gas such as carbon dioxide capable of dissolution under pressure and release or partial release from solution by pressure reduction and temperature rise of the coolant. The carbon dioxide and water coolant are first blended under pressure in mixer 40 which forces the carbon dioxide into true solution within the water such that the water 42 within the mold or casting device 18 is essentially of a single liquid phase. When the pressure is released as the coolant exits mold 18 through passageways 38, the carbon dioxide can evolve from solution.

As the coolant exits through passageways 38 as streams 39 and impinges upon the surface of the initially solidifying ingot shell 20, it establishes a first, relatively highly chilled zone 50. After the coolant has contacted the surface of the solidifying ingot shell 20, the action of the stable film promotion agent takes place to establish a second zone 60 with a heat extraction rate substantially decreased from that of the first zone 50, typically one-half or one-third or less thereof. This occurs, in the case where carbon dioxide is employed as the stable film-promoting agent, by the action of the carbon dioxide coming out of solution and also lowering the boiling point of the water, all of which favor the formation of a stable insulating film or layer 61 on the ingot surface. This markedly reduces the rate of heat extraction in zone 60, typically by several-fold, for instance five-fold or more over that of the first zone 50. The reduced cooling zone 60 is terminated at a predetermined length and predetermined distance from casting device 18 by the action of spray device 72 which directs a spray 74 to impinge upon and disturb or disrupt the insulative film or layer 61 which retarded the cooling rate in the second zone 60. While a spray device is illustrated in FIG. 1, a mechanical device such as a comb, rake or spatula, or any suitable device, may be employed, the object being to simply mechanically or physically distrub or interrupt the stable insulating film 61, but not to wipe off or substantially remove the liquid coolant initially applied to the solidifying surface through passages 38. Thus, the heat insulative effect of the stable film is disrupted by the action of spray 74 while the coolant initially applied through passages 38 remains on the surface of the ingot as a cooling sheath 76, its cooling effect in the third zone 70 unimpeded by the insulating film such that it extracts heat at a substantially higher rate than in second zone 60, at least two or three times the rate and typically several-fold higher, such as five or even ten times higher.

Figure 2:
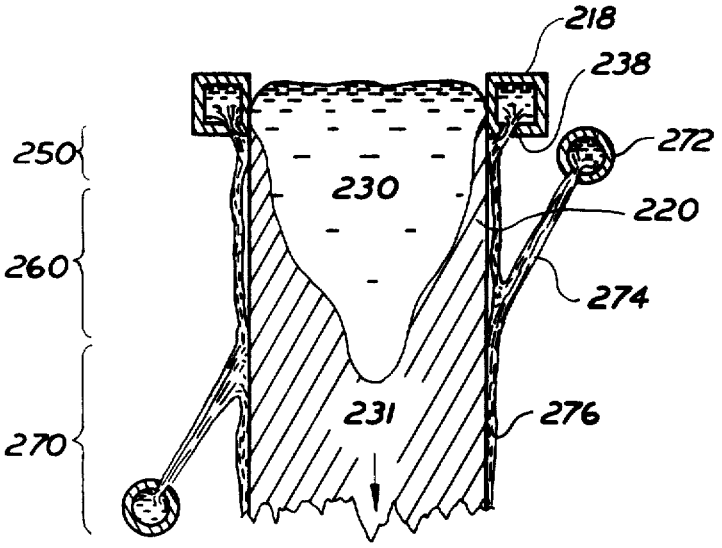
FIG. 2 is an elevation view in cross-section schematically illustrating the practice of the invention for vertical casting.

While the spray 74 may impinge substantially normal to the surface of the ingot 22, such is not necessarily critical in practicing the invention. Spray 74 may impinge at an angle substantially different from 90 degrees or normal and can impinge in a direction the same as the ingot withdrawal direction or the opposite direction as depicted in FIG. 2 where the spray 274 is shown as impinging in the direction of ingot withdrawal and at a substantial departure from normal impingement on the right side of the FIG. 2 view whereas it is shown at substantially the same angle but as impinging in the direction opposite ingot withdrawal on the left side of FIG. 2. The arrangement shown on the right-side of FIG. 2 has the advantage of positioning all of the ingot cooling provisions at substantially the same position as mold 218 which avoids practical problems which can be caused by positioning water supply 272 at a position further removed from the mold. Referring further to FIG. 2 it will be appreciated that reference numerals 220, 230, 231, 238, 250, 260, 270, and 276, respectively correspond to reference numerals 20, 30, 31, 38, 50, 60, 70, and 76 in FIG. 1.

Because of the effects of the three direct contact cooling effects, zones 50, 60 and 70, the line between the liquid pool 30 and the solid metal, liquidus 31, typically may assume a shape which departs slightly from the common parabolic shape and assumes a shape similar to a baby bottle nipple, as shown in FIG. 1.

As shown in the figures, the first direct contact cooling zone 50 is typically rather short. A typical length is about one-eighth inch to about one or two inches, for instance about one-quarter to one-half of an inch in length. The length of the second zone 60 should be greater than that of the first zone 50, at least twice the length thereof, preferably at least three or four times the length thereof, for instance a minimum length of one-half inch up to two or more times the diameter or thickness dimension of the ingot. A preferred length for the second cooling zone 60 ranges between three-fourths times and one-and-one-half times the thickness of the ingot 22. The term "thickness" is intended to refer to the diameter of a circular cross-section, the side of a square cross-section or the lesser of the two sides of a rectangular cross-section, that is a minor cross-sectional dimension lateral to the direction of ingot withdrawal. In test runs demonstrating the invention, it has been shown that the length of the stable insulative film which characterizes the second zone 60 can be as high as four to eight feet or more in length, if not disturbed by the action of a comb or the jets 74. Thus, it is the action of the jets or combs which terminate the second zone 60 at a predetermined length, preferably to a length not substantially greater than one or two times the thickness of the ingot 22.

As stated hereinabove, the second zone 60 is terminated by the impingement of jet or spray 74 which disrupts the stable heat insulative layer 61 formed in the second zone. This effect can be achieved without adding substantial coolant through spray 74. In fact, jet or spray 74 can be air or any other fluid or can be replaced by a mechanical or non-fluid means such as a rake or comb, as already discussed. Preferably, it is advantageous that the spray 74 be characterized by a relatively thin profile such as to provide the deepest penetration and, accordingly, more effective interruption or disturbance of the insulating film layer. To spread the disrupting effect around the periphery of an ingot, sprays with a fan-type pattern (a thin, flat, fan shape) can be used to advantage. This concentrates the spray energy in a fine band around the periphery to provide effective disruption of the insulating film layer. One of the advantages in using water over air or less energetic sprays is that water can be applied in energetic fan sprays to effectively disrupt the stable film around the periphery of the ingot and effectively terminate the second cooling zone 60 at a predetermined location along the ingot length.

The spray 39 exiting nozzles 38 to establish the first zone 50 should be energetic and impinge upon the ingot surface at a relatively high velocity. This provides for a high chill rate in the first zone so as to help build up the thickness of the embryo ingot skin 20 and reduce bleed-throughs or leaks out of the liquid core 30 through shell 20.

Where the same fluid such as water is employed for both streams 39 and 74, the practice of the invention involves a relatively high rate of coolant applied through nozzles 38 and streams 39 for the first zone 50 and a relatively minor amount applied at spray 74 which terminates the second zone 60. The amount of water applied through sprays 39 is typically greater than one-and-one-half or two times the spray 74 applied to end the second zone 60. As already indicated, spray 74 can be an air jet or could be replaced by a comb or other rake-like or non-fluid device to provide virtually no direct cooling effect on its own. In the typical practice of the invention employing water at both sprays 39 and 74, the initial spray 39 is two-and one-half or more times the second spray 74.

Figure 3:
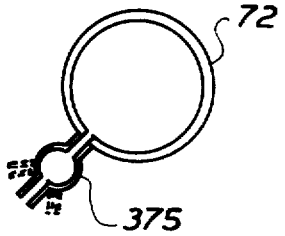
FIG. 3 is an elevation view schematically illustrating an arrangement useful in practicing the invention.

A convenient means for providing spray 74 is illustrated in FIG. 3 which shows supply pipe or tube 72 provided with pivotable nozzles 375 which can be aimed to impinge upon the ingot over a range of impingement points. This permits adjustment of the length of the second zone 60 as required or desired for a particular alloy or ingot withdrawal condition. As a general rule, as the second zone is increased in length the casting speed can be increased with less risk of cracking, but as the length of the second zone 60 becomes too long, such can introduce porosity into the ingot which in some cases can be undesirable.

As can be seen from the foregoing and FIGS. 1 and 2, the dominant ingot direct contact coolant effect is provided through sprays 39, which direct chill coolant effectively extracts the heat of solidification from the ingot. The effect of the coolant is high in the first zone 50 because of the impingement of coolant exiting channels 38. A stable insulative layer develops shortly after the impingement to establish the second zone 60 characterized by a retarded heat transfer rate in comparison with the first and third zones. Thus, essentially the coolant applied via sprays 39 in the first zone substantially provides the dominant heat extraction effect for all three cooling zones in accordance with the invention which can be accomplished without addition of any cooling fluid at the end of the second cooling zone. For instance, in ingot casting runs, the second zone has been terminated by disruption of the film by a simple manual means such as a spatula or a comb. While this is effective to demonstrate the practice of the invention, it will not be difficult to understand how manually disturbing the insulative film may not be the most efficient or convenient practice of the invention, which is more conveniently accomplished by equipment means such as spray 74 or a comb or scraper positioned as part of the casting equipment.

The direct chill coolant effect for the first zone 50 is substantially provided by the action of streams 39 impinging on the ingot surface to carry and provide coolant to the surface of the solidifying ingot. The same coolant so provided also serves as the direct chill coolant for the second zone 60, albeit at a heat extraction rate reduced by the insulative layer 61. Still the same coolant so provided serves as direct chill coolant in the third zone 70 in that its chill effect remains substantial and even dominant over the effect of spray 74. The direct chill coolant provided to the third zone 70 by carryover from the first and second zones 50 and 60 amounts to at least 40% or 50%, typically at least 60%, and preferably at least 70% or 75%, of the direct chill coolant effect in the third zone in terms of heat extracted or coolant applied. That is, the amount of coolant applied by sprays 74 is typically only one-half or less, such as one-fourth or one-third the amount of coolant applied by streams 39. To illustrate the dominant effect in the third zone 70 of the coolant carried over from the second zone 60, the sprays 74 can be turned off and substituted by combs or rakes without significant loss in the chill effects in the third zone 70.

The coolant employed to cool the ingot is preferably water but can be other fluids such as ethylene glycol, mineral oil, and other fluids, effective to extract heat. In accordance with the invention, the coolant should incorporate an additive effective to promote the formation of a stable insulating film along the ingot surface, which stable film is disruptable by impingement so as to establish and terminate the second zone characterized by reduced rates of heat extraction caused by such insulating film. In the case of water as a coolant, a preferred practice is to use a pressure dissolvable gas such as carbon dioxide. Not only is this preferred from the standpoint of economics and control, it will be found to introduce little or virtually no troublesome contaminants into the coolant which can readily be recycled and temporarily combined with carbon dioxide by pressure dissolution prior to being introduced into the mold cooling cavity 42 and thereafter evolved from solution by reduction in pressure as the coolant exits as streams 39 and the temperature rises in the coolant as it extracts heat from the metal cast. Other gases in addition to or in lieu of $CO_2$ which can be effective for dissolving into water coolant include hydrogen sulfide, ammonia, air, nitrogen and sulfur dioxide. Another additive which can be employed as an insulative layer promoter for water coolant is an alcohol, such as methyl or ethyl alcohol. Substances such as alcohol, which are soluble in water and have a vapor pressure higher than water at operating temperature, can promote the formation of stable insulating films by lowering the boiling point of the water coolant. Other surface-active substances such as electrolytes and polyelectrolytes can be added to water to promote formation of a stable film but without substantially lowering the boiling point. However, substances such as alcohol or surface-active agents tend to accumulate in the water as it is recycled and are less advantageous than the use of a temporarily soluble gas such as carbon dioxide, which is soluble under pressure but readily evolves from solution once the pressure is released as when the coolant exits passages 38 and the coolant temperature rises in response to the heat in the metal cast.

EXAMPLE

As an example of the practice of the invention, ingots approximately six inches in diameter were cast horizontally employing an arrangement such as that generally depicted in FIG. 1. In this arrangement, approximately 40 to 45 gallons per minute of water were pumped to the mold cooling chamber 42 and out nozzles 38 to impinge as streams 39 upon the surface of an ingot to establish the first cooling zone 50. The water had first been combined with carbon dioxide under pressure such that shortly after the streams 39 impinged upon the surface of the ingot, a stable film commenced forming and covered a substantial length of the ingot until disrupted by the action of jet streams 74 impinging upon the surface of the ingot to disrupt the film and establish the third zone 70. Aluminum alloys cast in this manner included Aluminum Association Alloys 6061, 6463 and 3003 and the casting rates varied from 6 to 9 inches per minute with neither ingot cracks nor porosity being encountered.

In practicing the invention it is advantageous to employ the casting start-up operation or process described in U.S. Pat. No. 4,166,495, incorporated herein by reference. In said process carbon dioxide or other gas is dissolved in water and applied at the starting condition where the mold is plugged with a starting block or starting plug and the casting run is initiated by pouring metal into the mold cavity closed by the starting plug and the starting plug then withdrawn with solidified or partially solidified ingot attached thereto. Once casting is initiated, the carbon dioxide use is reduced or terminated in said process. In combining said process with the present invention and employing water as the coolant and carbon dioxide as a gas temporarily dissolved therein, carbon dioxide is dissolved into the water at a relatively high rate at the start of the ingot withdrawal and thereafter at a reduced rate. For instance, for a coolant rate of about 40 to 45 gallons per minute dissolving around 5 or 6 SCFM of carbon dioxide at the start of the casting run and thereafter reducing the carbon dioxide to a rate of 3 or 4 SCFM, is effective. That is, the carbon dioxide comsumption per unit of liquid coolant after start-up decreases to around one-half to three fourths the level at start-up.

Figure 4:
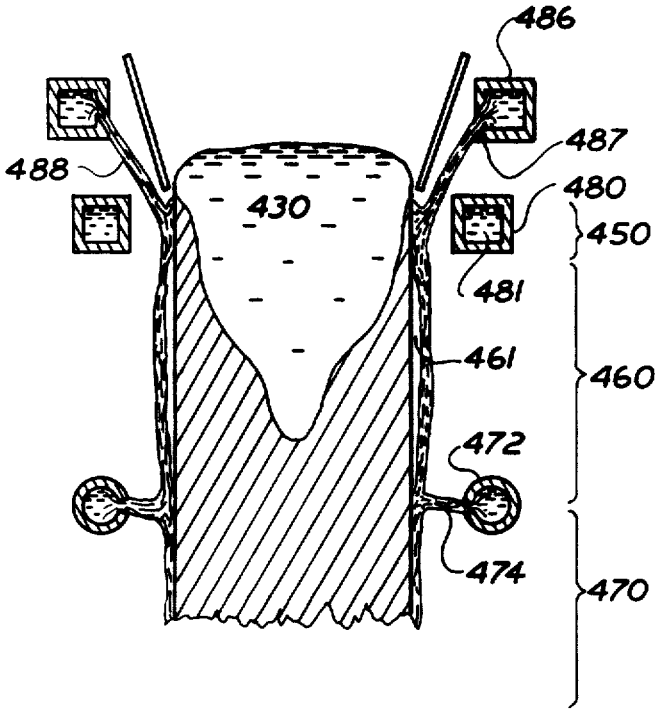
FIG. 4 is an elevation view in cross-section schematically illustrating another embodiment for the practice of the invention.

An application for which the present invention is considered useful occurs in electromagnetic casting where there is no chilled mold surface to contact and confine the liquid metal as it is solidifying. Instead, electromagnetic molds are used and the molten and solidifying metal are confined by electromagnetic forces so as to eliminate many of the surface imperfections caused by the use of molds in direct contact with the liquid and initially solidifying metal. Electromagnetic casting is described in U.S. Pat. No. 3,467,166, incorporated herein by reference, and illustrated in FIG. 4. Referring to FIG. 4, electromagnetic inductor 480 produces an electromagnetic field which confines the lateral dimensions in the upper or outer regions of the liquid metal pool 430 as the pool is initially formed. The inductor 480 may be cooled as by coolant passage 481. In the arrangement shown in FIG. 4, coolant for direct chill of the partially solidified ingot is provided through coolant supply 486 including passageway exits 487 to produce streams 488 which impinge upon the metal and establish the initial cooling zone 450. In accordance with the invention, the stable insulating film 461 is formed as with the use of carbon dioxide gas to establish the second chill zone 460 which said second chill zone 460 is substantially terminated by disruption of insulative layer 461 effected by spray 474 applied by supply header 472 to facilitate the third chill zone 470. Thus, the invention is considered suitable in casting practices using contact molds in accordance with the system generally shown in FIGS. 1 and 2, or it may be used in electromagnetic casting as generally illustrated in FIG. 4. In the latter area, changes may occur from the specific layout shown in FIG. 4. For instance, the direct chill coolant could be supplied through passageways in inductor 480 employing the inductor coolant from channel 481, although the arrangement illustrated in FIG. 4 may be preferred in some instances.

While the invention has been described in terms of preferred embodiments, the claims appended hereto are intended to encompass all embodiments which fall within the spirit of the invention.

What is claimed is:

1. In a process of continuously casting metal to provide a solidified ingot, the steps comprising:

(a) providing liquid metal to an ingot casting device to laterally confine the solidifying metal and withdrawing partially solidified metal ingot from said casting device;

(b) applying to the surface of said partially solidified metal in a first direct chill zone a coolant containing an agent which promotes the formation of a disruptable, but stable and sustained, insulating layer at the surface of said solidifying metal, said coolant extracting heat at a high rate of heat extraction in said first zone;

(c) said rate of heat extraction by said coolant applied in said step (b) being diminished in a second direct chill cooling zone positioned outward of the first cooling zone along the direction of ingot travel by the formation of a stable and sustained insulating layer in response to the action of said insulative layer-promoting agent provided in said step (b) in an amount to provide for said first zone and provide for said formation of said layer in said second zone, said second cooling zone being characterized by a rate of heat extraction substantially reduced in comparison with the rate of heat extraction in said first zone; and (d) physically interrupting said stable insulating film at a predetermined distance from the casting device thereby to increase the cooling rate of said coolant applied in step (b) to provide a third direct chill cooling zone outward from said first and second zones along the direction of ingot withdrawal and extracting heat at a higher rate than said second zone;

(e) said metal being successively passed through said three direct chill zones.

2. The process according to claim 1 wherein the rate of heat extraction in said first direct chill zone in said step (b) is attributable at least in part to energetic impingement upon the surface of the solidifying metal.

3. The process according to claim 1 wherein said layer-promoting agent is a gas dissolvable in said coolant.

4. The process according to claim 1 wherein said layer-promoting agent is a gas dissolvable in said coolant under pressure and releasable therefrom by pressure reduction or temperature increase or both.

5. The process according to claim 1 wherein said coolant comprises water.

6. The process according to claim 5 wherein said layer-promoting agent is carbon dioxide.

7. The process according to claim 5 wherein said layer-promoting agent is carbon dioxide dissolved in said water under pressure prior to said water being applied to said ingot surface in said step (b).

8. The process according to claim 1 wherein said interrupting in said step (d) is effected by application of energetic streams of fluid.

9. The process according to claim 1 wherein said interrupting in said step (d) is effected by application of energetic streams of fluid effective to interrupt said insulating layer without substantially disrupting said coolant applied in said step (b).

10. The process according to claim 1 wherein said interrupting in said step (d) is effected by application of fluid comprising further coolant, the amount thereof being less than one-half of that applied in said step (b).

11. The process according to claim 1 wherein said first zone is less than one-half the length of said second zone.

12. The process according to claim 1 wherein the length of said second zone is between one-half and two times the thickness of said ingot.

13. The process according to claim 1 wherein, in terms of heat extracted per unit length of ingot, the heat extraction in the first zone is at least twice that in the second zone.

14. The process according to claim 1 wherein, in terms of heat extracted per unit length of ingot, the heat extracted in the first and third zones is at least twice that in the second zone.

15. The process according to claim 1 wherein, in terms of heat extracted per unit length of ingot, the heat extracted in the third zone is at least five times that in the second zone.

16. The process according to claim 1 wherein the coolant applied in said step (b) provides the dominant cooling for all three direct chill zones.

17. The process according to claim 1 wherein said casting device comprises an electromagnetic mold and the solidifying metal is laterally confined by electromagnetic forces.

18. The process according to claim 1 wherein the metal is composed of aluminum or its alloys or magnesium or its alloys.

19. The process according to claim 1 wherein the rate of heat extraction in said first direct chill zone in said step (b) is attributable at least in part to direct heat exchange between the solidifying metal and coolant.

20. The process according to claim 1 wherein said agent is characterized by a vapor pressure higher than said coolant and a boiling point lower than said coolant.

21. The process according to claim 1 wherein said agent comprises an electrolyte or polyelectrolyte.

22. In a process of continuously casting metal to provide a solidified ingot, the steps comprising:

(a) providing liquid metal to an ingot casting device to laterally confine the solidifying metal and withdrawing partially solidified metal ingot from said casting device;

(b) applying to the surface of said partially solidified metal in a first direct chill zone a coolant comprising water and dissolved therein an agent which promotes the formation of a disruptable, but stable and sustained, insulating layer at the surface of said solidifying metal, said coolant extracting heat at a high rate of heat extraction in said first zone by substantially direct heat exchange between the coolant and said metal;

(c) said rate of heat extraction of said coolant applied in said step (b) being diminished in a second direct chill cooling zone positioned outward of the first cooling zone along the direction of ingot travel by the formation of a stable and sustained insulating layer in response to the action of said insulative layer-promoting agent provided in said step (b) in an amount to provide for said first zone and provide for said formation of said layer in said second zone, said second cooling zone being characterized by a rate of heat extraction substantially reduced in comparison with the rate of heat extraction in said first zone; and (d) physically interrupting said stable insulating film at a predetermined distance from said casting device thereby to increase the cooling rate of said coolant applied in step (b) by establishing increased direct heat exchange between said coolant and said metal to provide a third direct chill cooling zone outward from said first and second zones along the direction of ingot withdrawal and extracting heat at a higher rate than said second zone;

(e) said metal being successively passed through said three direct chill zones;

(f) said coolant applied in said first zone according to said step (b) providing cooling for the subsequent second and third zones in said steps (c) and (d).

23. The process according to claim 22 wherein the rate of heat extraction in said first direct chill zone in said step (b) is attributable at least in part to energetic impingement upon the surface of the solidifying metal.

24. The process according to claim 22 wherein said layer-promoting agent is a gas dissolvable in said coolant.

25. The process according to claim 22 wherein said layer-promoting agent is a gas dissolvable in said coolant under pressure and releasable therefrom by pressure reduction or temperature increase or both.

26. The process according to claim 22 wherein said layer-promoting agent is carbon dioxide.

27. The process according to claim 22 wherein said layer-promoting agent is carbon dioxide dissolved in said coolant under pressure prior to said water being applied to said ingot surface in said step (b).

28. The process according to claim 22 wherein said interrupting in said step (d) is effected by application of energetic streams of fluid.

29. The process according to claim 22 wherein said interrupting in said step (d) is effected by application of energetic streams of fluid effective to interrupt said insulating layer without substantially disrupting said coolant applied in said step (b).

30. The process according to claim 22 wherein said interrupting in said step (d) is effected by application of fluid comprising further coolant, the amount thereof being less than one-half of that applied in said step (b).

31. The process according to claim 22 wherein said first zone is less than one-half the length of said second zone.

32. The process according to claim 22 wherein the length of said second zone is between one-half and two times the thickness of said ingot.

33. The process according to claim 22 wherein, in terms of heat extracted per unit length of ingot, the heat extracted in the first zone is at least twice that in the second zone.

34. The process according to claim 22 wherein, in terms of heat extracted per unit length of ingot, the heat extracted in the first and third zones is at least twice that in the second zone.

35. The process according to claim 22 wherein, in terms of heat extracted per unit length of ingot, the heat extracted in the third zone is at least five times that in the second zone.

36. The process according to claim 22 wherein the coolant applied in said step (b) provides the dominant cooling for all three direct chill zones.

37. The process according to claim 22 wherein said casting device comprises an electromagnetic mold and the solidifying metal is laterally confined by electromagnetic forces.

38. The process according to claim 22 wherein the metal is composed of aluminum or its alloys or magnesium or its alloys.

39. The process according to claim 22 wherein said agent is characterized by a vapor pressure higher than said coolant and a boiling point lower than said coolant.

40. The process according to claim 22 wherein said agent comprises an electrolyte or polyelectrolyte.

41. In a process of continuously casting metal to provide a solidified ingot, the steps comprising:

(a) providing liquid metal to an ingot casting device to laterally confine the solidifying metal and withdrawing partially solidified metal ingot from said casting device;

(b) applying to the surface of said partially solidified metal in a first direct chill zone a coolant comprising water and dissolved therein under pressure a gas dissolvable in water under pressure which comes out of solution by pressure reduction or temperature increase or both, said coolant extracting heat at a high rate of heat extraction in said first zone by substantially direct heat exchange between the coolant and said metal;

(c) said rate of heat extraction of said coolant applied in said step (b) being diminished in a second direct chill cooling zone positioned outward of the first cooling zone along the direction of ingot travel by the formation of a stable and sustained insulating layer in response to said gas coming out of solution, said gas being provided in said step (b) in an amount to provide for said first zone and provide for said formation of said layer in said second zone, said second cooling zone being characterized by a rate of heat extraction per unit length one-half or less than the rate of heat extraction in said first zone; and (d) physically interrupting said stable insulating film at a predetermined distance from the casting device by the action of an energetic water stream applied in an amount less than one-half the amount applied in said step (b) thereby to increase the cooling rate of said coolant provided in step (b) by establishing increased direct heat exchange between said coolant provided in said step (b) and said metal to provide a third direct chill cooling zone outward from said first and second zones along the direction of ingot withdrawal and extracting heat at a rate per unit length at least three times that of said second zone;

(e) said metal being successively passed through said three direct chill zones;

(f) said coolant applied in said step (b) providing cooling for the subsequent second and third zones in said steps (c) and (d);

(g) said predetermined distance in said step (d) providing a length for said second direct chill zone more than twice that of said first zone and between one-half and two times the thickness of said ingot.

42. The process according to claim 41 wherein at the initiation of casting said gas is provided in said step (b) at a higher rate which is reduced to a lower rate after initiation of casting.

43. The process according to claim 41 wherein the rate of heat extraction in said first direct chill zone in said step (b) is attributable at least in part to energetic impingement upon the surface of the solidifying metal.

44. The process according to claim 41 wherein said gas comprises carbon dioxide.

45. The process according to claim 41 wherein said casting device comprises an electromagnetic mold and the solidifying metal is laterally confined by electromagnetic forces.

46. The process according to claim 41 wherein the metal is composed of aluminum or its alloys.

47. The process according to claim 41 wherein the rate of heat extraction per unit length in said third zone is at least five times that of said second zone.

* * * * *